US006773189B1

(12) United States Patent
Tsaur

(10) Patent No.: US 6,773,189 B1
(45) Date of Patent: Aug. 10, 2004

(54) MULTI-DIRECTIONAL APPLICATOR

(76) Inventor: Garry Tsaur, 19222 Tranbarger St., Rowland Heights, CA (US) 91748

( * ) Notice: Subject to any disclaimer, the term of this patent is extended or adjusted under 35 U.S.C. 154(b) by 0 days.

(21) Appl. No.: 10/728,702

(22) Filed: Dec. 5, 2003

(51) Int. Cl.[7] ..... B43K 5/14
(52) U.S. Cl. ..... 401/132; 401/134; 604/3
(58) Field of Search ..... 401/132–135; 604/3; 220/278; 222/81, 83–85

(56) References Cited

U.S. PATENT DOCUMENTS 3,924,623 A * 12/1975 Avery ..... 604/3
4,740,194 A * 4/1988 Barabino et al. ..... 401/132
5,035,348 A * 7/1991 Seifert ..... 401/132
5,782,801 A * 7/1998 Caillouette ..... 604/3
5,791,801 A * 8/1998 Miller ..... 401/132

* cited by examiner

*Primary Examiner*—Tuan N. Nguyen
(74) *Attorney, Agent, or Firm*—Joe Nieh

(57) ABSTRACT

A multi-directional applicator comprising an elongated tube with a sealed end and an open end with an applicator tip affixed to the open end of the elongated tube and multiple score lines formed along the length of the elongated tube. The elongated tube is affixed within an elongated tubular housing with two ends that are sealed near the two ends of the elongated tube and encloses a fluid. When the elongated tube is fractured at one of its score line by bending the elongated tubular housing and the elongated tube the fluid within the elongated tubular housing may be squeezed out of the elongated tubular housing through the fractured opening into the elongated tube and into applicator tip.

9 Claims, 1 Drawing Sheet

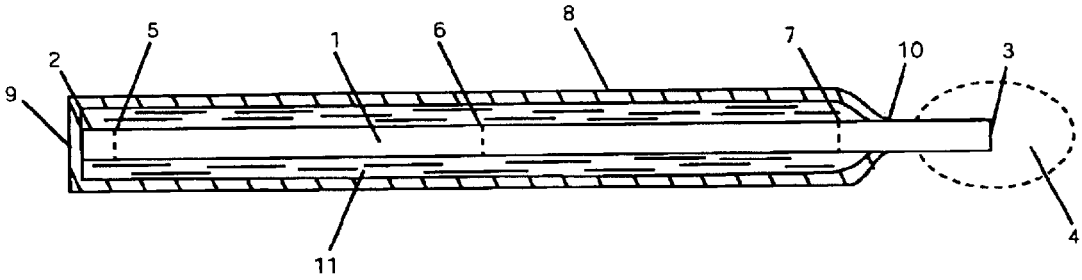
9
2
5
1
6
8
7
10
3
4
11

MULTI-DIRECTIONAL APPLICATOR

BACKGROUND—FIELD OF INVENTION

The present invention relates generally to a swab applicator. More specifically the present invention relates to a swab applicator that contains a liquid.

BACKGROUND—DESCRIPTION OF RELATED ART

Swab applicator generally comprises of a tubular handle with a formed absorbent tip at one or both ends of the tubular handle. The absorbent tip may be made of cotton or a foam absorbent material. The tip may also be a brush. The tubular handle may be made of wood, paper, or plastic and it may be solid or hollow.

Swab applicators have a variety of applications. Swab applicators are a convenient and sanitary means for applying and removing a variety of substances such as liquids, lotions, creams, and various chemicals and medications. Generally the applicator tip of a dry swab applicator is first placed in contact with the liquid to be applied for the applicator tip to absorb the liquid. Subsequently, the moisturized applicator tip is placed in contact with the surface to apply the absorbed liquid to the surface. Swab applicators may also be used to remove substances such as makeup and other specimens by wiping the substance with the applicator tip to remove and retrieve the substance.

Some swab applicators with hollow tubular handles may contain a liquid within the hollow enclosure of the tubular handle. However, the liquid can only be released into the applicator tip by orienting the applicator tip downward to allow gravity to pull the liquid down from within the hollow tubular handle into the applicator tip. When the applicator tip is oriented upward the liquid will not continue to flow into the applicator tip and once the remaining liquid in the applicator tip is depleted, the swab applicator must be inverted to orient the applicator tip downward to replenish the depleted liquid in the applicator tip.

SUMMARY OF THE INVENTION

The present invention is a swab applicator with enclosed fluid. The enclosed fluid may be released to the applicator tip regardless of the orientation of the swab applicator. The multi-directional applicator comprises of an elongated tube with a sealed end and an open end. An applicator tip is affixed to the open end of the elongated tube and multiple score lines are formed along the length of the elongated tube. The elongated tube is affixed within an elongated tubular housing with two ends that are sealed near the two ends of the elongated tube and encloses a fluid. When the elongated tube is fractured at one of its score line by bending the elongated tubular housing and the elongated tube the fluid within the elongated tubular housing may be squeezed out of the elongated tubular housing through the fractured opening into the elongated tube and into the applicator tip. The multi-directional applicator may be used in any orientation by selectively fracturing the elongated tube at a score line that is submerged in the fluid. The quantity of the fluid released may also be controlled by selectively fracturing the elongated tube at a score line that is submerged in the fluid with the fluids above the score line being releasable.

BRIEF DESCRIPTION OF THE DRAWINGS

FIG. 1 shows the preferred embodiment of the multi-directional applicator.

DETAILED DESCRIPTION OF THE PREFERRED EMBODIMENT

The FIGURE shows the preferred embodiment of the present invention. In the preferred embodiment, the multi-directional applicator comprises of an elongated tube 1 with a sealed end 2 and an open end 3. An applicator tip 4 is affixed to the open end 3 of the elongated tube 1 and multiple score lines 5, 6, 7 are formed along the length of the elongated tube 1. The applicator tip 4 may be a cotton swab, a foam tip, or a brush tip. In the preferred embodiment, three score lines 5, 6, 7 are formed along the length of the elongated tube 1 with a first score line 5 near the sealed end 2, a second score line 7 near the open end 3, and a third score line 6 disposed between the first and second score lines approximately equal distance from the first and second score lines.

The elongated tube 1 is affixed within an elongated tubular housing 8 with two ends 9, 10 that are sealed near the two ends 2, 3 of the elongated tube 1 and encloses a fluid 11. In the preferred embodiment, the sealed end 2 of the elongated tube 1 is affixed to a sealed end 9 of the elongated tubular housing 8. When the elongated tube 1 is fractured at one of its score lines 5, 6, 7 by bending the elongated tubular housing 8 and the elongated tube 1 the fluid 11 within the elongated tubular housing 8 may be squeezed out of the elongated tubular housing 8 through the fractured opening into the elongated tube 1 and into the applicator tip 4.

The multi-directional applicator may be used in any orientation by selectively fracturing the elongated tube 1 at a score line 5, 6, 7 that is submerged in the fluid 11. The quantity of the fluid 11 released may also be controlled by selectively fracturing the elongated tube 1 at a score line 5, 6, 7 that is submerged in the fluid 11 with the fluid 11 above the score line being releasable. For example, if the applicator tip 4 is oriented upward, the score line 5 near the sealed end 2 of the elongated tube 1 may be fractured and substantially all of the fluid 11 may be released into the applicator tip 4 by squeezing the elongated tubular housing 8. If the score line 6 near the middle of the elongated tube 1 is fractured instead, approximately half of the fluid 11 will be released into the applicator tip 4 when the elongated tubular housing 8 is squeezed. As a further example, if the applicator tip 4 is oriented downward, the score line 7 near the open end 3 of the elongated tube 1 may be fractured and substantially all of the fluid 11 may be released into the applicator tip 4 by squeezing the elongated tubular housing 8. If the score line 6 near the middle of the elongated tube 1 is fractured instead, only approximately half of the fluid 11 will be released into the applicator tip 4 when the elongated tubular housing 8 is squeezed.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A multi-directional applicator comprising:

an elongated tube with a sealed end and an open end and with one or more score lines formed along the length of the elongated tube;

an applicator tip affixed to the open end of said elongated tube; and an elongated tubular housing substantially enclosing said elongated tube with two ends that are sealed near the two ends of said elongated tube and encloses a fluid;

wherein when said elongated tube is fractured at one of its score line by bending said elongated tubular housing and said elongated tube the fluid within said elongated tubular housing may be squeezed out of said elongated tubular housing through the fractured opening, into the elongated tube, and into the applicator tip.

2. A multi-directional applicator as in claim 1, wherein said applicator tip is made of an absorbent material.

3. A multi-directional applicator as in claim 1, wherein said applicator tip is made of a brush.

4. A multi-directional applicator as in claim 1, 2, or 3, wherein three score lines are formed along the length of said elongated tube with a first score line near the sealed end, a second score line near the open end, and a third score line disposed between the first and second score lines approximately equal distance from the first and second score lines.

5. A multidirectional applicator as in claim 1, 2, or 3, wherein said sealed end of the elongated tube is affixed to a sealed end of the elongated tubular housing.

6. A multi-directional applicator as in claim 4, wherein said sealed end of the elongated tube is affixed to a sealed end of the elongated tubular housing.

7. A multi-directional applicator comprising:

an elongated tube with a sealed end and an open end and with one or more score lines formed along the length of the elongated tube; and an elongated tubular housing substantially enclosing said elongated tube with two ends that are sealed near the two ends of said elongated tube and encloses a fluid;

wherein when said elongated tube is fractured at one of its score line by bending said elongated tubular housing and said elongated tube the fluid within said elongated tubular housing may be squeezed out of said elongated tubular housing through the fractured opening, into the elongated tube, and out through the open end of said elongated tube.

8. A multi-directional applicator as in claim 7, wherein three score lines are formed along the length of said elongated tube with a first score line near the sealed end, a second score line near the open end, and a third score line disposed between the first and second score lines approximately equal distance from the first and second score lines.

9. A multi-directional applicator as in claim 7 or 8, wherein said sealed end of the elongated tube is affixed to a sealed end of the elongated tubular housing.

* * * * *